US008946995B2

(12) United States Patent
Pflaum

(10) Patent No.: US 8,946,995 B2
(45) Date of Patent: Feb. 3, 2015

(54) LED DRIVER CIRCUIT

(71) Applicant: Infineon Technologies Austria AG, Villach (AT)

(72) Inventor: Bernd Pflaum, Unterhaching (DE)

(73) Assignee: Infineon Technologies Austria AG, Villach (AT)

( * ) Notice: Subject to any disclaimer, the term of this patent is extended or adjusted under 35 U.S.C. 154(b) by 78 days.

(21) Appl. No.: 13/748,409

(22) Filed: Jan. 23, 2013

(65) Prior Publication Data

US 2014/0203709 A1 Jul. 24, 2014

(51) Int. Cl.

| | |
|---|---|
| ***H05B 37/00*** | (2006.01) |
| ***H05B 41/00*** | (2006.01) |
| ***H01H 71/00*** | (2006.01) |
| ***H05B 37/02*** | (2006.01) |

(52) U.S. Cl.
CPC ..... *H05B 37/0227* (2013.01)
USPC ..... 315/127; 315/120; 337/14

(58) Field of Classification Search
CPC ..... H05B 41/2855; H05B 41/2851; B23H 1/024; B23H 1/026; H02H 7/127
USPC ..... 315/127, 120, 121, 124, 125; 337/14
See application file for complete search history.

(56) References Cited

U.S. PATENT DOCUMENTS

| | | | | |
|---|---|---|---|---|
| 6,538,394 | B2 * | 3/2003 | Hurtz et al. | 315/291 |
| 8,456,096 | B2 * | 6/2013 | Kwok et al. | 315/219 |
| 2006/0022918 | A1 * | 2/2006 | Tang et al. | 345/84 |
| 2010/0066270 | A1 * | 3/2010 | Yang et al. | 315/309 |
| 2011/0115399 | A1 * | 5/2011 | Sadwick et al. | 315/287 |
| 2011/0199013 | A1 * | 8/2011 | Cottrell | 315/250 |
| 2012/0161633 | A1 * | 6/2012 | Nishitani et al. | 315/117 |
| 2012/0268040 | A1 * | 10/2012 | Riesebosch | 315/309 |
| 2013/0293139 | A1 * | 11/2013 | Sadwick et al. | 315/224 |
| 2014/0028377 | A1 * | 1/2014 | Rosik et al. | 327/513 |

OTHER PUBLICATIONS

"STCF02—High Power White Led Driver," ST Microelectronics, Rev 6, Feb. 2007, 19 pages.

"2MHz, High-Brightness LED Drivers with Integrated MOSFET and High-Side Current Sense," MAXIM, MAX16832A/MAX16832C, Rev. 5, Mar. 2012, 3 pages.

* cited by examiner

*Primary Examiner* — Dylan White
(74) *Attorney, Agent, or Firm* — Slater & Matsil, L.L.P.

(57) ABSTRACT

A semiconductor chip includes an LED driver circuit operably coupled to at least one LED and configured to supply a load current to the at least one LED such that an average load current matches a desired current level defined by a drive signal. A temperature measurement circuit is thermally coupled to the LED driver circuit or the LED(s) or both, and is configured to generate, as drive signal, a temperature dependent signal in such a manner that the drive signal is approximately at a higher constant level for temperatures below a first temperature, is approximately at a lower constant level for temperatures above a second temperature but below a maximum temperature, and continuously drops from the higher constant level to the lower constant level for temperatures rising from the first temperature to the second temperature.

20 Claims, 3 Drawing Sheets

LED DRIVER CIRCUIT

TECHNICAL FIELD

The present description relates to circuits and methods for driving light emitting diodes (LEDs), particularly to circuits and methods for driving LEDs including an over temperature protection.

BACKGROUND

Light emitting diodes (LEDs) are becoming increasingly popular as energy-saving substitute for incandescent lamps in various applications. Unlike incandescent lamps LEDs are current-driven components and as such require driver circuits including a load current regulation. In order to reduce power dissipation within the driver circuits switched mode power supplies are usually employed to supply a LED or a series circuit of several LEDs (also referred to as LED chain) with a well-defined load current. Generally, the resulting luminous intensity (usually measured in candela) is directly proportional to the load current. The power dissipation within the driver circuit (even when including a switching converter) may, however, still become a problem which—if no security mechanism is included—may result in a thermal destruction of the driver circuit, particularly of the power stages included therein. Not only the power stages of the LED driver but also the LEDs themselves are at risk to overheat.

For this purpose many LED driver devices (including an integrated driver circuit) include a sense terminal (i.e., a chip pin) to which an external temperature sensor may be attached (usually as an option). For example, the high power white LED driver STCF02 of STM (see STMicroelectronics, data sheet STCF02, February 2007) provides a chip pin for connecting an NTC temperature sensor which is a temperature dependent resistor (thermistor) having a negative temperature coefficient (NTC). The external temperature sensor is usually used to trigger a shut-down of the device when a critical temperature has been detected.

However, in security relevant applications (e.g., the illumination of emergency exits, escape routes, emergency shut-down switches, etc.) a simple shut-down of the LED driver is insufficient as maintaining the illumination is essential. Furthermore, also in non-security related applications reliability (even in hot environments or where sufficient cooling is problematic) may also be a desired feature of an illumination device including a LED driver and respective LEDs. Finally, it is desirable to reduce the required external components necessary to operate the LED driver and to protect the driver as well as the LEDs. The still required external components should be inexpensive and easy in integrate into an illumination device.

Thus there is a need for improved LED driver circuits that are easy to use and include an intelligent over-temperature protection.

SUMMARY OF THE INVENTION

A semiconductor chip including integrated circuitry for driving LEDs is described. In accordance with one example of the invention the circuit comprises a LED driver circuit operably coupled to at least one LED and configured to supply a load current to the at least one LED such that an average load current matches a desired current level determined by a drive signal. A temperature measurement circuit is thermally coupled to the LED driver circuit and configured to generate, as drive signal, a temperature dependent signal in such a manner that the drive signal is approximately at a higher constant level for temperatures below a first temperature, approximately at a lower constant level for temperatures above a second temperature but below a maximum temperature, and continuously drops from the higher constant level to the lower constant level for temperatures rising from the first temperature to the second temperature.

BRIEF DESCRIPTION OF THE DRAWINGS

The invention can be better understood with reference to the following drawings and descriptions. The components in the figures are not necessarily to scale, instead emphasis is placed upon illustrating the principles of the invention. Moreover, in the figures, like reference numerals designate corresponding parts. In the drawings.

DETAILED DESCRIPTION OF ILLUSTRATIVE EMBODIMENTS

Figure 1A:
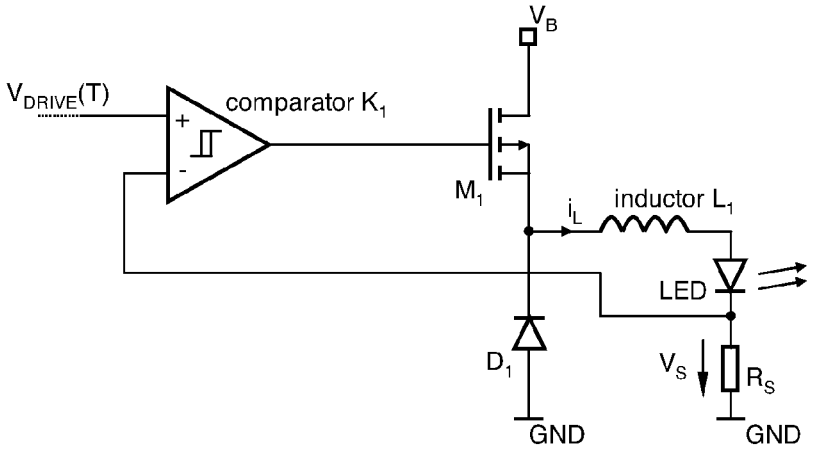
FIG. 1*a* illustrates an exemplary LED driver circuit including a buck converter for driving a LED, the load current being supplied to the LED depends on a temperature dependent drive signal.
Figure 1B:
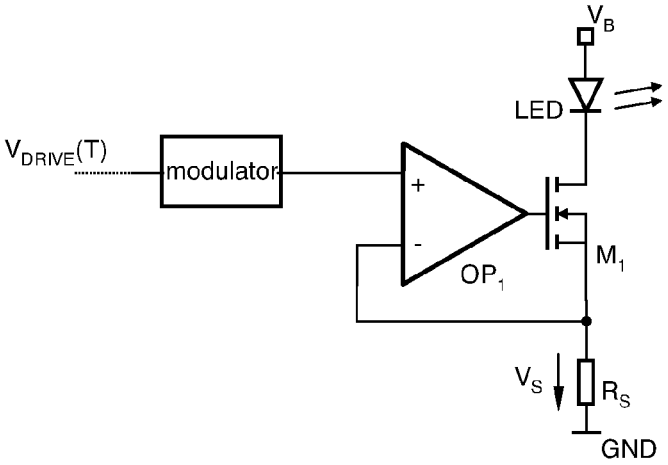
FIG. 1*b* illustrates another exemplary LED driver circuit which provides a modulated load current to a LED, the average load current (which determines the luminous intensity) corresponds to a duty cycle which is set in accordance with a temperature dependent drive signal.
Figure 1C:
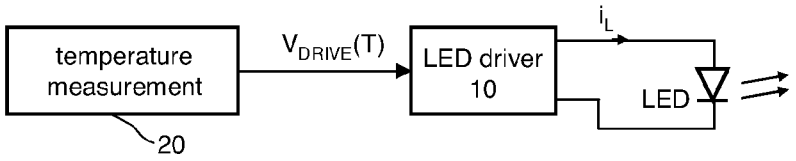
FIG. 1*c* illustrates a circuit that includes a temperature measurement circuit, an LED driver and an LED.

FIG. 1, which includes FIGS. 1*a*-1*c*, illustrates difference examples of LED driver circuits. In the example of FIG. 1*a* the driver circuit includes a switching converter (precisely, a buck converter) whereas, in the example of FIG. 1*b*, the driver circuit includes a modulator MOD to provide a modulated load current to the LED. The modulator MOD may be any common on/off-modulator such as a pulse width modulator (PWM), a pulse frequency modulator (PFM), a sigma-delta modulator or the like.

The circuit of FIG. 1*a* includes a first semiconductor switch, which is implemented as a MOS transistor $M_1$, and a second semiconductor switch, which is implemented as a silicon diode $D_1$. The MOS transistor $M_1$ and the diode $D_1$ are connected in series between a first supply terminal supplied with a first supply potential $V_B$ and a second supply terminal GND supplied with a second supply potential, e.g., ground potential VGND. The MOS transistor $M_1$ and the diode $D_1$ form a kind of a half bridge wherein the common circuit node of the transistor $M_1$ and the diode $D_1$ is the half-bridge output node at which the load current iL is provided. The LED is connected to that half-bridge output node via an inductor L1. As such a first inductor terminal is connected to the half-bridge output node whereas a second inductor terminal is connected to the anode of the LED. The cathode of the LED is coupled to the second supply terminal GND via a current sensing resistor RS such that LED, inductor L1 and resistor RS form a series circuit. The voltage drop $V_S$ across the resistor RS is representative of (in the present example proportional to) the load current iL passing through the LED. A comparator K1 with hysteresis receives the a temperature dependent drive signal VDRIVE(T) and the voltage drop $V_S$ representing the load current iL. The output of the comparator K1 is coupled to the gate of the MOS transistor $M_1$, e.g., via a designated gate driver circuit (not shown).

When voltage $V_S=R_S \cdot i_L$ falls below the lower threshold VDRIVE-ΔV, the output of the comparator $K_1$ drives the MOS transistor $M_1$ into an on-state in which the load current $i_L$ passes from the first supply terminal to the second supply terminal GND via the MOS transistor $M_1$, the inductor L1, the LED, and the sense resistor RS. In this case the diode $D_1$ is reverse biased. When the voltage $V_S=R_S i_L$ exceeds the higher threshold $V_{DRIVE}+\Delta V$, the output of the comparator $K_1$ drives the MOS transistor $M_1$ into an off-state in which—due to the self-inductance of the inductor $L_1$—the load current $i_L$ passes from the second supply terminal GND via the diode $D_1$ (which is then forward biased), the inductor $L_1$, the LED, and the sense resistor RS back to the second supply terminal GND. As a result, the average load current $i_{AVG}$ corresponds to $V_{DRIVE}$ (i.e., $V_{AVG}=V_{DRIVE}/R_S$) whereas the peak-to-peak value of the ripple current is $2 \cdot \Delta V$. It should be noted that the LED driver circuit illustrated in FIG. 1*a* has to be regarded as an example. The MOS transistor $M_1$ may be replaced by any other type of transistor, the diode $D_1$ may be substituted by an adequately driven transistor. The LED is coupled to the low side of the circuit. However, the LED may also be placed in a high-side configuration.

FIG. 1*b* illustrates another exemplary driver circuit which does not require an inductor. In the present example the LED is connected in series with the load current path of a transistor $M_1$ (e.g., the drain-source current path in case of a MOSFET) and a current sense resistor RS. The total supply voltage ($V_B-V_{GND}$) is applied to this series circuit. In the present example the load current iL passes from the first supply terminal (which is supplied with the first supply potential $V_B$) via the LED, the transistor's load current path, and the resistor RS to the second supply terminal GND which is supplied with a second supply potential $V_B$, e.g., ground potential. The instantaneous load current value is dependent on the conduction state of the transistor $M_1$. As in the previous example, the voltage drop $V_S$ (sense signal) across the sense resistor RS represents the load current iL wherein the voltage drop $V_S$ equals $R_S i_L$. In the current example, the transistor $M_1$ is driven by an operational amplifier whose output is coupled to the gate of the transistor $M_1$ (e.g., via a designated gate driver, not shown). The operational amplifier $OP_1$ is supplied with the sense signal $V_S$ and a corresponding reference signal $V_M$. It operates as a P-regulator which regulates the load current $i_L$ (by appropriately controlling the conductance of the transistor $M_1$) such that the sense signal $V_S$ approximately equals the reference signal $V_M$, which is tantamount to $i_L=V_M/R_S$. That is, the load current is regulated to a value $V_M/R_S$ corresponding to the reference signal $V_M$.

The reference voltage is usually an on/off-modulated signal having an amplitude and a variable duty cycle D, wherein $D \in [0, 1]$. As a result, the load current $i_L$ passing through the LED will be correspondingly on/off-modulated. The average load current $i_{AVG}$ (which determines the perceivable luminous intensity of the LED) is then $i_{AVG}=i_{LON} \cdot D$ wherein $i_{LON}$ is the on-value of the load current $i_L$ whereas its off-value is zero. The on/off-modulated signal VM is usually generated by a common analog or digital modulator which is configured to generate the on/off-modulated signal $V_M$ and to set the duty cycle D to a value corresponding to a drive signal $V_{DRIVE}$. As in the previous example, the drive signal $V_{DRIVE}$ is temperature dependent and indirectly determines the average load current $i_{AVG}$ passing through the LED.

The general concept is summarized below with reference to FIG. 1*c*. A LED driver 10 is coupled to a LED (or a series circuit of LEDs) and configured to provide a load current $i_L$ to the LEDs. The LED driver 10 generates the load current $i_L$ in accordance with a drive signal $V_{DRIVE}$ such that the average load current $i_{AVG}$ matches the drive signal. Thus, the drive signal indirectly determines the average load current $i_{AVG}$ and thus the luminous intensity of the LED. The drive signal is provided by a temperature measurement circuit 20 which generates the drive signal $V_{DRIVE}$ such that it depends on temperature. The temperature dependency of the drive signal $V_{DRIVE}$ follows some specific characteristic curve which is described further below with reference to FIGS. 2 and 3. The temperature measurement circuit 20, the LED driver circuit may be in close thermal contact. For example, both circuits 10, 20 may be included in one integrated circuit (IC) placed in one single chip package. A detailed example of the circuit 20 will be described further below with reference to FIG. 4. The circuit 20 usually includes an integrated temperature sensor such as, for example, a diode.

Figure 2:
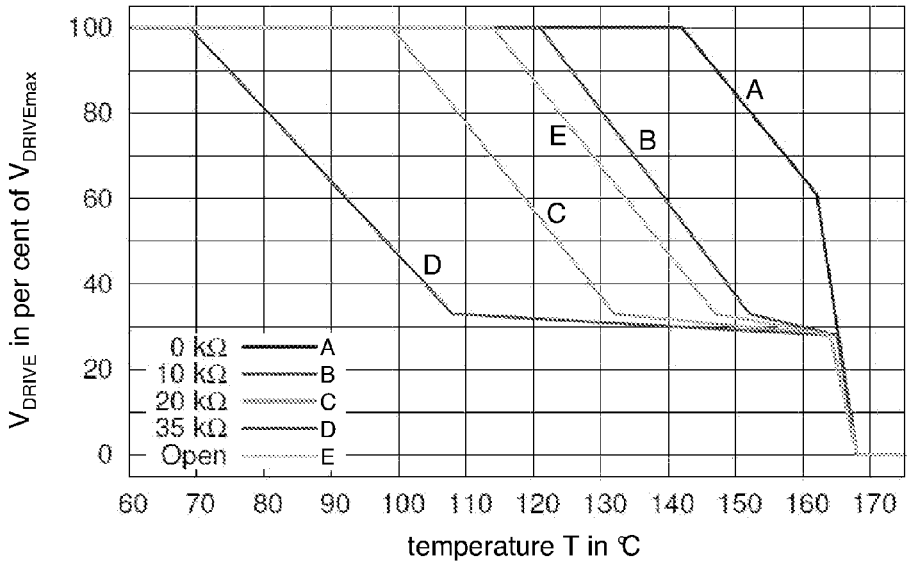
FIG. 2 illustrates one exemplary ensemble of characteristic curves representing the temperature dependency of the drive signal.

FIG. 2 illustrates a specific example of how the drive signal $V_{DRIVE}$ depends on the temperature T. The diagram shown in FIG. 2 illustrates the drive voltage in percent of a maximum drive voltage level $V_{DRIVEmax}$ which is provided at low temperatures, e.g., below 70° C. When a specific first temperature (further referred to as temperature $T_1$) is exceeded, the drive voltage $V_{DRIVE}$ is reduced. The decrease of the drive voltage $V_{DRIVE}$ continues as the temperature continues rising. The maximum drive voltage level $V_{DRIVEmax}$ and the rate of the mentioned decrease (in volts per Kelvin) may be set by appropriate circuit design. When a specific second temperature (further referred to as temperature $T_2$) is exceeded, the drive voltage remains approximately constant or is further reduced at a much lower rate. In the present example, the drive voltage $V_{DRIVE}$ stays at approximately 40 percent of the maximum level $V_{DRIVEmax}$ for temperatures above 108° C. However, when the temperature still rises and exceeds a maximum temperature $T_{MAX}$ then a thermal shut-down is initiated. In the present example $T_{MAX}$ is approximately 160° C. The maximum temperature $T_{MAX}$ may also be set by appropriate circuit design. The temperature measurement circuit 20 (see FIG. 1*c*) may be configured to allow the adjustment of the first temperature $T_1$ and the second temperature $T_2$ using an external component such as an external resistor. This allows integrating the temperature measurement circuit 20 and the driver circuit 10 (see FIG. 1*c*) into one single chip package and to allow the user to configure the temperature characteristic of the drive voltage $V_{DRIVE}$ by attaching a single external resistor to one specific pin of the chip package.

Figure 3:
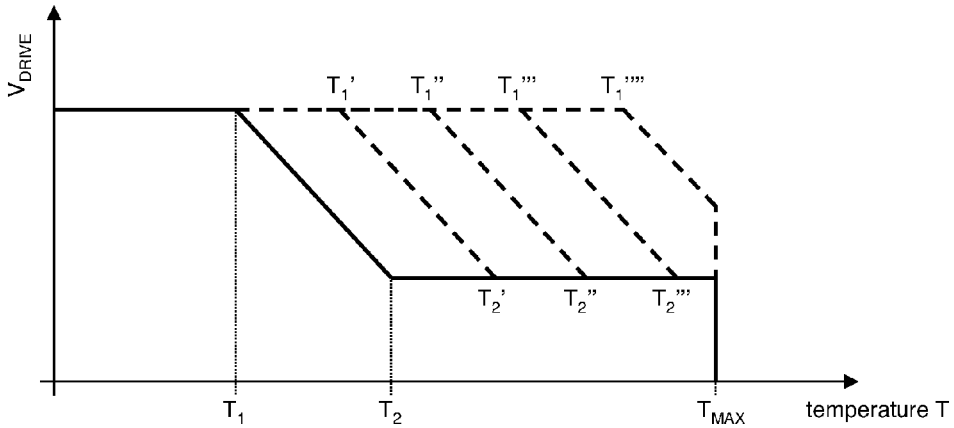
FIG. 3 illustrates one abstract exemplary of the characteristic curve of FIG. 2 including the parameters that determine the characteristic curve.

FIG. 3 illustrates the temperature characteristic of the drive voltage on a more abstract level. The solid line illustrates one specific characteristic curve describing the behavior of the circuit 20, which provides the temperature dependent drive voltage $V_{DRIVE}(T)$. Below a first temperature $T_1$ the drive voltage $V_{DRIVE}$ approximately equals the maximum drive voltage level $V_{DRIVEmax}$. Above a second temperature $T_2$ the drive voltage $V_{DRIVE}$ approximately equals the low drive voltage level $V_{DRIVElow}$ provided that, however, the temperature remains below the maximum temperature $T_{MAX}$ ($T_{MAX}>T_2$). A temperature equal to or higher than $T_{MAX}$ triggers an overcurrent shut-down of the driver circuit. Between the first temperature $T_1$ and the second temperature $T_2$ the drive voltage drops approximately linearly. However, any other smooth or continuous transition between $V_{DRIVEmax}$ and $V_{DRIVElow}$ would be appropriate.

Reducing the drive voltage $V_{DRIVE}$ at elevated temperatures (above $T_1$) entails a lower average load current passing through the LED resulting in a lower power dissipation in both, the driver circuit 10 as well as the LED(s). The lower power dissipation counteracts a further increase in temperature and may lead to a cooling-down of the LED and the driver circuit. However, the flat portion of the curve for temperatures T lower than $T_1$ ensures that the load current $i_L$ and thus the perceivable luminous intensity is maintained on a constant desired level during normal operation in a pre-definable temperature range $T<T_1$. The gradual decrease of the drive voltage helps to reduce the dissipated power and thus reduces the risk of overheating. However, the perceivable luminous intensity is also reduced. The flat portion of the characteristic curve for high temperatures $T>T_2$ is provided to maintain a defined minimum luminous intensity (corresponding to a minimum drive voltage $V_{DRIVEmin}$), which is advantageous in security relevant applications such as illumination of emergency exits, emergency shut-off switches or the like. To avoid a thermal destruction of the driver circuit, the circuit is deactivated when the temperature exceeds a maximum temperature $T_{MAX}$. $A_S$ long as the temperature remains lower than the maximum temperature $T_{MAX}$ a thermal equilibrium may occur at any point on the curve shown in FIG. 3, dependent on the actual temperature of the driver circuit and the ambient temperature.

The parameters $T_1$ and $T_2$ fully determine the characteristic curves. According to one example of the invention these parameters may be set by adjusting the resistance on one external resistor connected to the measurement circuit. As such the curve defined by the temperatures $T_1'$ and $T_2'$, $T_1''$ and $T_2''$, $T_1'''$ and $T_2'''$, and $T_1''''$ may be chosen (the temperature $T_2''''$ corresponding to $T_1''''$ would be higher than $T_{MAX}$ and thus ineffective).

Figure 4:
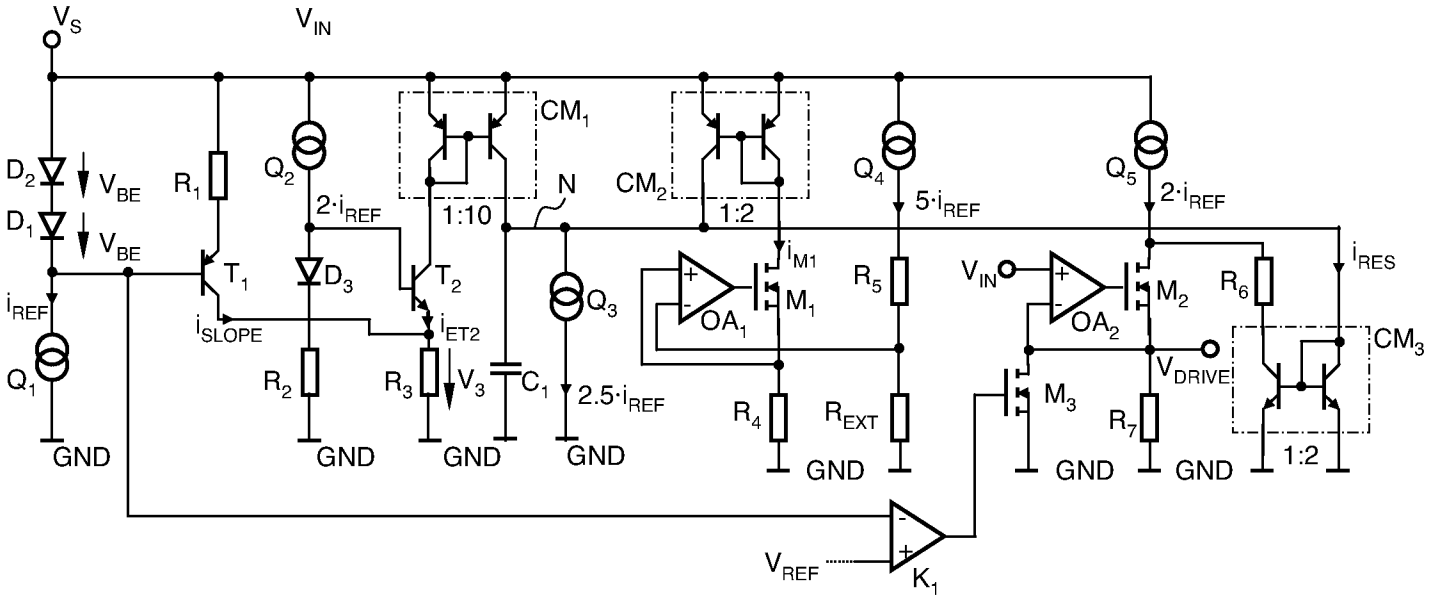
FIG. 4 illustrates one exemplary temperature measurement circuit configured to generate the drive signal in accordance with the characteristic curve of FIG. 2.

One exemplary measurement circuit that allows an efficient implementation of the measurement circuit is illustrated in FIG. 4. The circuit of FIG. 4 is supplied with a supply voltage $V_S$ with respect to a reference potential referred to as ground potential GND in the present circuit. The circuit of FIG. 4 is further provided with an input voltage $V_{IN}$ (corresponds to $V_{DRIVEmax}$ in FIG. 2) that which sets the maximum output voltage $V_{DRIVE}(T)$. Several reference current sources $Q_1$, $Q_2$, $Q_3$, $Q_4$, and $Q_5$ are used in the circuit. All these current sources provide fixed multiples of a reference current $i_{REF}$ which is essentially temperature independent. For this purpose a band-gap reference circuit may be used to generate a temperature independent reference current, and all current sources may derive the sourced current from the stable output current of the band-gap reference circuit.

In the present example the temperature dependent forward voltage $V_{BE}$ of a two silicon diodes $D_1$ and $D_2$ are used to provide the middle portion of the characteristic curve (between temperatures $T_1$ and $T_2$) depicted in FIG. 3. The forward voltage $V_{BE}$ of a diode (this is also valid for the base-emitter-diode of a bipolar transistor) has a temperature coefficient of about −2 mV/° C., that is the voltage $V_{BE}$ drops for about 2 mV as the temperature rises by one degree Celsius. The two diodes $D_1$ and $D_2$ are connected in series to a first current source $Q_1$, which provides a current $i_{REF}$. The diodes $D_1$ and $D_2$ are connected between the supply node at which the supply potential VS is provided and the current source $Q_1$. The voltage drop $2\cdot V_{BE}$ across the diodes $D_1$, $D_2$ is converted into a temperature dependent current $i_{SLOPE}$ which approximately equals $V_{BE}/R_1$. For this purpose a bipolar transistor $T_1$ (pnp type) is provided. The emitter of the transistor $T_1$ is connected so the supply node via the resistor $R_1$ (emitter resistor) and the base of the transistor $T_1$ is connected to the common circuit node of current source $Q_1$ and diode $D_1$. As a consequence, the voltage drop across the emitter resistor $R_1$ is approximately $V_{BE}$ (assuming the base-emitter voltage of transistor T1 is also $V_{BE}$) and thus the collector current of the transistor $T_1$ (denoted as $i_{SLOPE}$) equals $V_{BE}/R_1$ (assuming the base current of the transistor $T_1$ is negligible). Therefore the current $i_{SLOPE}$ exhibits the same temperature dependency as the diode forward voltage $V_{BE}$. In essence the transistor $T_1$ and the resistor $R_1$ can be regarded as voltage-to-current converter which converts the temperature dependent forward voltage $V_{BE}$ into a corresponding current $i_{SLOPE}$.

The current $i_{SLOPE}$ adds to the emitter current $i_{ET2}$ of a second bipolar transistor $T_2$ (npn type) and the sum current $i_{SLOPE}+I_{ET2}$ is directed through the resistor $R_3$ to the ground node, at which the ground potential GND is provided. That is, the resistor R3 is connected between the emitter of transistor $T_2$ and ground. The base of the transistor $T_2$ is supplied with a base voltage of $2\cdot i_{REF}\cdot R_2+V_{BE}$, whereby the current $2\cdot i_{REF}$ is provided by the second current source $Q_2$, the voltage $V_{BE}$ is the forward voltage of a further diode $D_3$. The resistor $R_2$ is connected in series with the diode $D_3$ and the current source $Q_2$ such that the sourced current $2\cdot i_{REF}$ is mainly (i.e., neglecting the base current of transistor $T_2$) directed through the diode $D_3$ and the resistor $R_2$. The transistor $T_2$ essentially operates as an emitter follower and thus the emitter voltage $V_3$ of the transistor $T_2$ follows essentially the base voltage minus the forward voltage of the base-emitter diode. That is, the emitter voltage $V_3$ equals approximately the voltage drop across the resistor $R_2$ and thus $V_3=2\cdot i_{REF}\cdot R_2$. As a result the emitter current $i_{ET2}$ of the transistor $T_2$ can be calculated as $i_{ET2}=2\cdot i_{REF}\cdot R_2/R_3-i_{SLOPE}$. This emitter current $i_{ET2}$ is copied and magnified by a factor 10 using the current mirror $CM_1$. That is, the current mirror output current at the circuit node N equals $20\cdot i_{REF}\cdot(R_2/R_3)-10\cdot i_{SLOPE}$. The capacitor $C_1$ coupled to the current mirror output node (node N) is used to suppress transient current spikes. In essence, the current mirror $CM_1$ in combination with the transistor $T_2$ (and the circuitry for biasing the base of the transistor $T_2$) and the resistor $R_3$ can be regarded as subtracting circuit configured to subtract the current $i_{SLOPE}$ from a pre-defined constant current $(2\cdot i_{REF}\cdot R_2/R_3)$.

The first break of slope of the characteristic curve of FIG. 3 at temperature $T_1$ (temperature threshold) may be set by appropriately choosing the values of the resistors $R_1$, $R_2$, and $R_3$, wherein the steepness of the slope between the temperatures $T_1$ and $T_2$ is mainly determined by the value of resistor $R_1$. The characteristic curve of FIG. 3 may be shifted to the right as illustrated in FIG. 3 by means of the resistors $R_4$, $R_5$, and $R_{EXT}$, which is an external component placed outside the chip, the MOS transistor $M_1$, the current source $Q_4$, and the operational amplifier $OA_1$, particularly by adjusting the resistance of the external resistor $R_{EXT}$. Accordingly, the current source $Q_4$ sources a current $5\cdot i_{REF}$ which is directed through the resistors $R_5$ and $R_{EXT}$ which are connected in series between the current source $Q_4$ and the ground node GND. Furthermore, the resistor $R_4$ is connected between the ground node GND and the source electrode of the MOS transistor $M_1$, which has a gate electrode that is driven by the output of the operational amplifier $OA_1$. The operational amplifier $OA_1$ controls the MOS transistor such that the voltage drops across the resistor $R_{EXT}$ and the resistor $R_4$ are approximately equal. The resulting drain current passing through the MOS transistor (n-channel type) is denoted as $i_{M1}$. As such, the terminals of the resistors $R_{EXT}$ and $R_4$ not connected to ground are connected to the inverting and non-inverting inputs of the operational amplifier $OA_1$, respectively. As the voltage $i_{M1}\cdot R_4=5\cdot i_{REF}\cdot R_{EXT}$, it follows that the current $i_{M1}$ equals $5 \cdot i_{REF} \cdot R_{EXT}/R_4$. The current iM1 is copied and downscaled to the output of the current mirror output branch of current mirror $CM_2$. The respective mirror current $0.5 \cdot i_{M1} = 5 \cdot i_{REF} \cdot R_{EXT}/R_4$ is also supplied to the circuit node N. As compared to the mirror current ($10 \cdot i_{ET2}$) at the output of the first current mirror $CM_1$ the mirror current ($0.5 \cdot i_{M1}$) does not significantly depend on temperature. In essence the current mirror $CM_2$ in combination with the circuitry providing the input current to the current mirror $CM_2$ can be regarded as current source providing an offset current (i.e., the mirror output current $2 \cdot i_{M1}$) that can be set using the external resistor $R_{EXT}$.

The minimum drive voltage $V_{DRIVEmin}$ (see FIG. 3) may be set my appropriately choosing the resistors $R_6$ and $R_7$ which are used in combination with the third current mirror $CM_3$, the MOS transistor $M_2$ (n-channel type), the current source $Q_5$, and the operationally amplifier $OA_2$. The input branch sinks the residual current $i_{RES}$ from circuit node N, whereby another current $2.5 \cdot i_{REF}$ is sunk from node N using current source $Q_3$. That is, $i_{RES}$ calculates as $i_{RES} = 10 \cdot i_{ET2} + 0.5 \cdot i_{M1} - 2.5 \cdot i_{REF}$. This residual current $i_{RES}$ is copied and downscaled to the output branch of the current mirror $CM_3$. A series circuit of current source $Q_5$ (sourcing a current of $2 \cdot i_{REF}$), MOS transistor $M_2$ and resistor $R_7$ is connected between the supply node (supply voltage $V_S$) and the ground node, wherein the MOS transistor is connected between the resistor $R_7$ and the current source $Q_5$, and the resistor $R_7$ is connected between the MOS transistor $M_2$ and the ground node. The gate of MOS transistor $M_2$ is controlled by the operational amplifier $OA_2$, which receives the input voltage $V_{IN}$ (corresponds to $V_{DRIVEmax}$) at its non-inverting input and the voltage across resistor $R_7$ at its inverting input. The output branch of the current mirror $CM_3$ is connected to the drain of the MOS transistor $M_2$ via resistor $R_6$. That is, the resulting drain current of the MOS transistor $M_2$ is the current $2 \cdot i_{REF}$ provided by the current source $Q_5$ minus the (mirrored and downscaled) residual current $0.5 \cdot i_{RES}$ which is sunk by the current mirror CM3 via resistor $R_6$. Thereby the voltage drop across the resistor $R_6$ is $R_6 \cdot i_{RES}$.

At low temperatures, the current $0.5 \cdot i_{RES}$ sunk by the current mirror $CM_3$ is low and thus the operational amplifier may regulate the output voltage (drive voltage $V_{DRIVE}$) to equal the input voltage $V_{IN}$, while the current source $Q_5$ operates as a high-impedance active load. As the temperature rises, the current $0.5 \cdot i_{RES}$ sunk by the current mirror $CM_3$ also rises and the operational amplifier saturates and the MOS transistor M2 becomes fully conductive with a low drain-source voltage drop. In this operational state the drive voltage $V_{DRIVE}$ will follow the voltage drop across the resistor $R_6$ which is temperature dependent. This voltage drop across the resistor $R_6$ will not exceed the value $0.5 \cdot i_{REF} \cdot R_6$ (as the current source $Q_5$ will not deliver more). Thus, the value of $R_6$ determines the minimum drive voltage $V_{DRIVEmin}$.

Finally, the comparator $K_1$ in combination with the further MOS transistor $M_3$ may be used to deactivate the drive voltage $V_{DRIVE}$ when a maximum temperature $T_{MAX}$ is exceeded (see FIG. 3). The comparator is configured to compare the voltage $V_S - 2 \cdot V_{BE}$ with a reference voltage representing the maximum temperature. In case the voltage $V_S - 2 \cdot V_{BE}$ drops below the reference voltage $V_{REF}$ (at a temperature $T_{MAX}$) then the MOS transistor, which is controlled by the comparator output, will clamp the output voltage $V_{DRIVE}$ to zero volts.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. It should be mentioned that features explained with reference to a specific figure may be combined with features of other figures, even in those where not explicitly been mentioned. Further, the methods of the invention may be achieved in either all software implementations, using the appropriate processor instructions, or in hybrid implementations that utilize a combination of hardware logic and software logic to achieve the same results. Such modifications to the inventive concept are intended to be covered by the appended claims.

What is claimed is:

1. A semiconductor chip including integrated circuitry, the semiconductor chip comprising:

an LED driver circuit configured to be coupled to an LED to supply a load current to the LED such that an average load current matches a desired current level defined by a drive signal; and a temperature measurement circuit configured to be thermally coupled to the LED driver circuit or the LED or both to generate, as a drive signal, a temperature dependent signal in such a manner that the drive signal is approximately at a higher constant level for temperatures below a first temperature, is approximately at a lower constant level for temperatures above a second temperature but below a maximum temperature, and continuously drops from the higher constant level to the lower constant level for temperatures rising from the first temperature to the second temperature.

2. The semiconductor chip of claim 1, wherein the temperature measurement circuit is further configured to shut down the LED driver circuit when the temperature reaches or exceeds the maximum temperature.

3. The semiconductor chip of claim 1, further comprising a pin for externally connecting a resistor of a defined resistance, wherein the temperature measurement circuit is configured to be operably coupled to the resistor and wherein the first and the second temperatures are determined by the resistance.

4. The semiconductor chip of claim 1, further comprising a modulator configured to receive the drive signal and to provide an on/off modulated signal having a duty cycle corresponding to the desired current level.

5. The semiconductor chip of claim 1, wherein the temperature measurement circuit includes a forward biased silicon diode having a forward voltage with a negative temperature coefficient.

6. The semiconductor chip of claim 5, wherein the temperature measurement circuit includes a voltage-to-current-converter coupled to the silicon diode to generate a temperature dependent current representing the forward voltage of the silicon diode.

7. The semiconductor chip of claim 6, wherein the temperature measurement circuit includes a subtracting circuit configured to provide a difference current substantially equal to a pre-defined constant current minus the temperature dependent current representing the forward voltage of the silicon diode.

8. The semiconductor chip of claim 7, further comprising a pin configured to be externally connected to a resistor of a defined resistance; and a current source configured to generate an offset current that depends on the resistance of the externally connected resistor.

9. The semiconductor chip of claim 8, in which the offset current and the difference current superpose in a circuit node resulting in a residual current that depends on temperature.

10. The semiconductor chip of claim 9, further comprising:

a further current source configured to generate a substantially constant current, wherein a current proportional to the residual current is subtracted from the substantially constant current;

a transistor coupled in series to the current source such that a first portion of the substantially constant current can pass through the transistor;

a resistor coupled in series to the transistor, wherein a voltage drop across the resistor forms the drive signal; and an operational amplifier having an output coupled to a control electrode of the transistor and configured to provide a control signal to the transistor representing the difference between the drive signal and an input signal.

11. An apparatus comprising:

an LED;

semiconductor chip including integrated circuitry, the semiconductor chip comprising:

an LED driver circuit coupled to an LED to supply a load current to the LED such that an average load current matches a desired current level defined by a drive signal; and a temperature measurement circuit thermally coupled to the LED driver circuit or the LED or both to generate, as a drive signal, a temperature dependent signal in such a manner that the drive signal is approximately at a higher constant level for temperatures below a first temperature, is approximately at a lower constant level for temperatures above a second temperature but below a maximum temperature, and continuously drops from the higher constant level to the lower constant level for temperatures rising from the first temperature to the second temperature.

12. The apparatus of claim 11, wherein the temperature measurement circuit is further configured to shut down the LED driver circuit when the temperature reaches or exceeds the maximum temperature.

13. The apparatus of claim 11, further comprising an external resistor having a defined resistance and coupled to the semiconductor chip, wherein the temperature measurement circuit is operably coupled to the external resistor and wherein the first and the second temperatures are determined by the defined resistance.

14. The apparatus of claim 11, wherein the semiconductor chip further comprises a modulator configured to receive the drive signal and to provide an on/off modulated signal having a duty cycle corresponding to the desired current level.

15. The apparatus of claim 11, wherein the temperature measurement circuit includes a forward biased silicon diode having a forward voltage with a negative temperature coefficient.

16. The apparatus of claim 15, wherein the temperature measurement circuit includes a voltage-to-current-converter coupled to the silicon diode to generate a temperature dependent current representing the forward voltage of the silicon diode.

17. The apparatus of claim 16, wherein the temperature measurement circuit includes a subtracting circuit configured to provide a difference current substantially equal to a predefined constant current minus the temperature dependent current representing the forward voltage of the silicon diode.

18. The apparatus of claim 17, further comprising an external resistor of a defined resistance coupled to the semiconductor chip, wherein the semiconductor chip further comprises a current source configured to generate an offset current that depends on the resistance of the resistor.

19. The apparatus of claim 18, in which the offset current and the difference current superpose in a circuit node resulting in a residual current that depends on temperature.

20. The apparatus of claim 19, wherein the semiconductor chip further comprises:

a further current source configured to generate a substantially constant current, wherein a current proportional to the residual current is subtracted from the substantially constant current;

a transistor coupled in series to the current source such that a first portion of the substantially constant current can pass through the transistor;

a resistor coupled in series to the transistor, wherein a voltage drop across the resistor forms the drive signal; and an operational amplifier having an output coupled to a control electrode of the transistor and configured to provide a control signal to the transistor representing the difference between the drive signal and an input signal.

* * * * *